US006564460B1

(12) United States Patent
Hundley

(10) Patent No.: US 6,564,460 B1
(45) Date of Patent: May 20, 2003

(54) DETACHABLE CIRCULAR SAW GUARD

(76) Inventor: David J. Hundley, 415 Woodland Rd., Gaithersburg, MD (US) 20877

( * ) Notice: Subject to any disclaimer, the term of this patent is extended or adjusted under 35 U.S.C. 154(b) by 19 days.

(21) Appl. No.: 09/944,021

(22) Filed: Sep. 1, 2001

(51) Int. Cl.[7] ..... B25F 5/02
(52) U.S. Cl. ..... 30/390; 30/391; 30/286
(58) Field of Search ..... 30/123, 123.3, 30/124, 388, 389, 390, 391, 286, 295; 144/252.1

(56) References Cited

U.S. PATENT DOCUMENTS 2,876,810 A 3/1959 Peterson et al.
3,662,796 A * 5/1972 Batistelli ..... 30/390
4,043,237 A 8/1977 Pyle
5,159,759 A * 11/1992 Fringer ..... 30/390
D344,879 S 3/1994 Chan
5,537,748 A 7/1996 Takahashi et al.
5,737,843 A 4/1998 Fringer et al.
D400,417 S 11/1998 Moran

* cited by examiner

*Primary Examiner*—Hwei-Siu Payer

(57) ABSTRACT

A detachable circular saw guard for providing additional protection while using a circular saw. The detachable circular saw guard includes a panel having a first end edge, a second end edge, a first side edge and a second side edge. The panel has an inner surface and an outer surface. The panel has an arcuate shape such that the first and second side edges generally have a half-circle shape. A coupling element is attached to the inner surface of the panel for removably coupling the panel to the blade guard.

6 Claims, 3 Drawing Sheets

DETACHABLE CIRCULAR SAW GUARD

BACKGROUND OF THE INVENTION

1. Field of the Invention

The present invention relates to circular saw guard devices and more particularly pertains to a new detachable circular saw guard for providing additional protection while using a circular saw.

2. Description of the Prior Art

The use of circular saw guard devices is known in the prior art. More specifically, circular saw guard devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,537,748; U.S. Pat. No. 5,737,843; U.S. Pat. No. 4,043,237; U.S. Pat. No. 2,876,810; U.S. Des. Pat. No. 400,417; and U.S. Des. Pat. No. 344,879.

While these devices fulfill their respective, particular objectives and requirements, the aforementioned patents do not disclose a new detachable circular saw guard. The inventive device includes device comprises a panel having a first end edge, a second end edge, a first side edge and a second side edge. The panel has an inner surface and an outer surface. The panel has an arcuate shape such that the first and second side edges generally have a half-circle shape. A coupling means is attached to the inner surface of the panel for removably coupling the panel to the blade guard.

In these respects, the detachable circular saw guard according to the present invention substantially departs from the conventional concepts and designs of the prior art, and in so doing provides an apparatus primarily developed for the purpose of providing additional protection while using a circular saw.

SUMMARY OF THE INVENTION

In view of the foregoing disadvantages inherent in the known types of circular saw guard devices now present in the prior art, the present invention provides a new detachable circular saw guard construction wherein the same can be utilized for providing additional protection while using a circular saw.

The general purpose of the present invention, which will be described subsequently in greater detail, is to provide a new detachable circular saw guard apparatus and method which has many of the advantages of the circular saw guard devices mentioned heretofore and many novel features that result in a new detachable circular saw guard which is not anticipated, rendered obvious, suggested, or even implied by any of the prior art circular saw guard devices, either alone or in any combination thereof.

To attain this, the present invention generally comprises a panel having a first end edge, a second end edge, a first side edge and a second side edge. The panel has an inner surface and an outer surface. The panel has an arcuate shape such that the first and second side edges generally have a half-circle shape. A coupling means is attached to the inner surface of the panel for removably coupling the panel to the blade guard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable circular saw guard apparatus and method which has many of the advantages of the circular saw guard devices mentioned heretofore and many novel features that result in a new detachable circular saw guard which is not anticipated, rendered obvious, suggested, or even implied by any of the prior art circular saw guard devices, either alone or in any combination thereof.

It is another object of the present invention to provide a new detachable circular saw guard which may be easily and efficiently manufactured and marketed.

It is a further object of the present invention to provide a new detachable circular saw guard which is of a durable and reliable construction.

An even further object of the present invention is to provide a new detachable circular saw guard which is susceptible of a low cost of manufacture with regard to both materials and labor, and which accordingly is then susceptible of low prices of sale to the consuming public, thereby making such detachable circular saw guard economically available to the buying public.

Still yet another object of the present invention is to provide a new detachable circular saw guard which provides in the apparatuses and methods of the prior art some of the advantages thereof, while simultaneously overcoming some of the disadvantages normally associated therewith.

Still another object of the present invention is to provide a new detachable circular saw guard for providing additional protection while using a circular saw.

Yet another object of the present invention is to provide a new detachable circular saw guard which includes a panel having a first end edge, a second end edge, a first side edge and a second side edge. The panel has an inner surface and an outer surface. The panel has an arcuate shape such that the first and second side edges generally have a half-circle shape. A coupling means is attached to the inner surface of the panel for removably coupling the panel to the blade guard.

Still yet another object of the present invention is to provide a new detachable circular saw guard that is retrofittable to existing circular saws.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
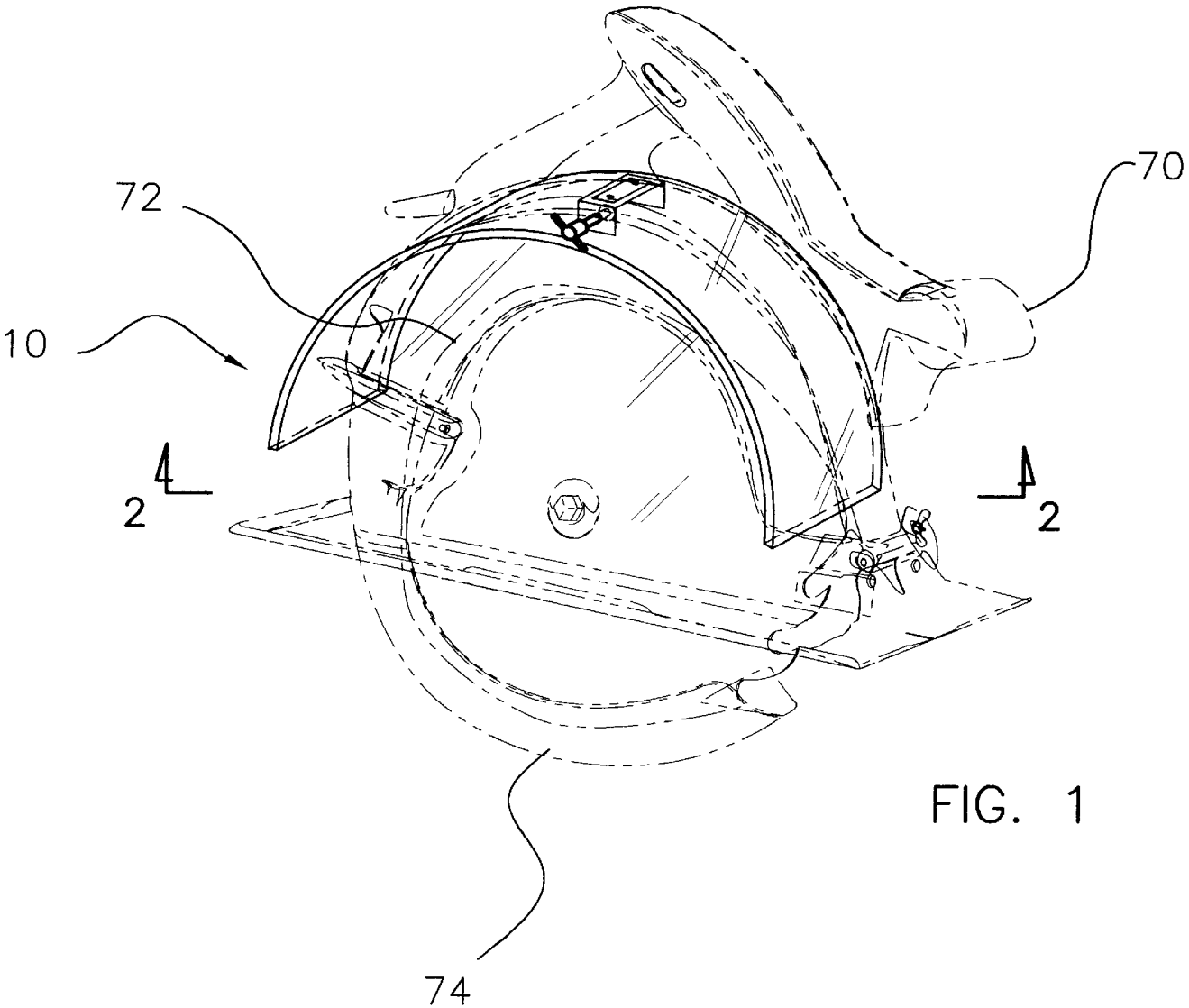
FIG. 1 is a schematic perspective view of a new detachable circular saw guard according to the present invention.
Figure 2:
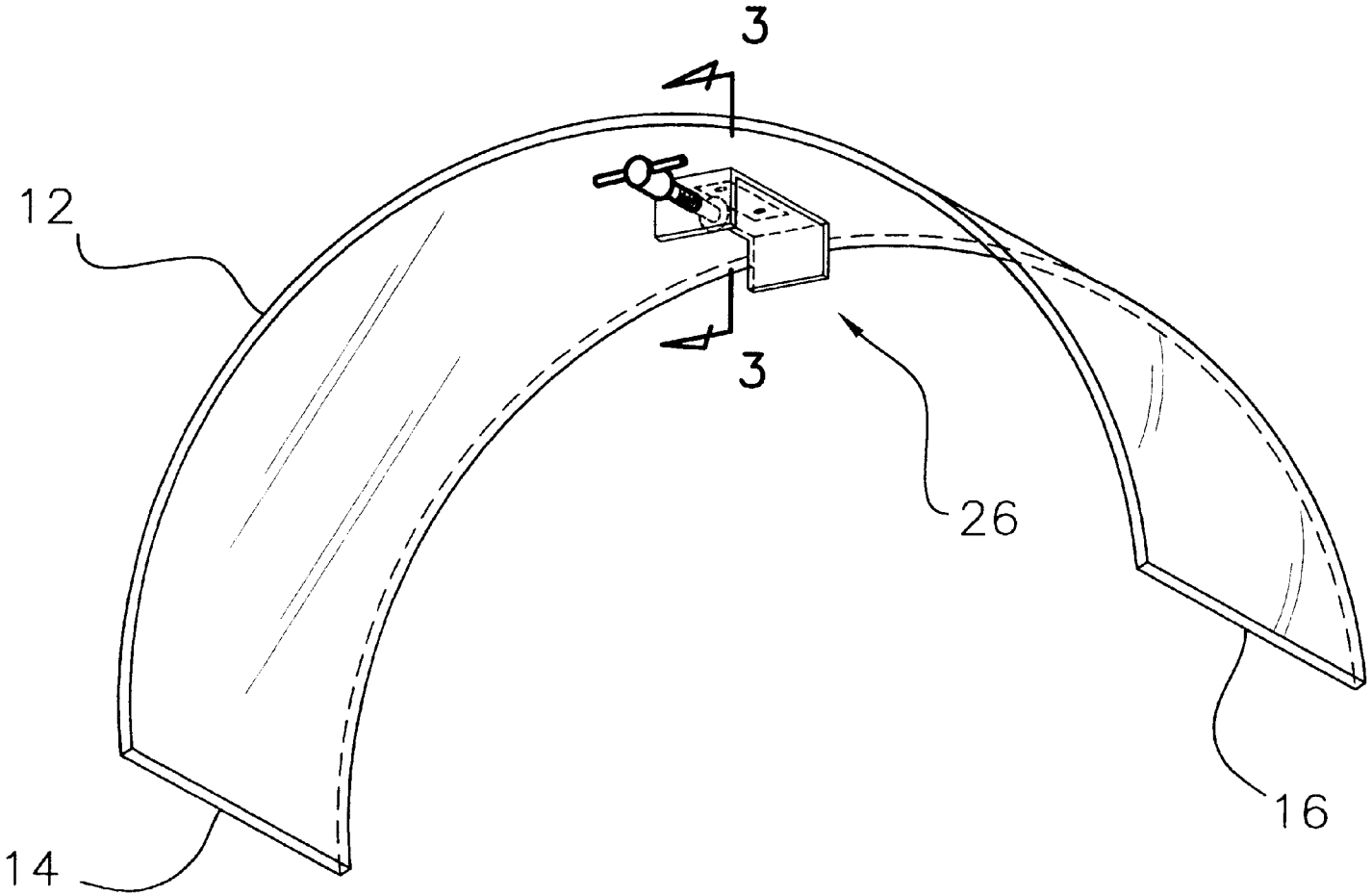
FIG. 2 is a schematic perspective view of the present invention.
Figure 3:
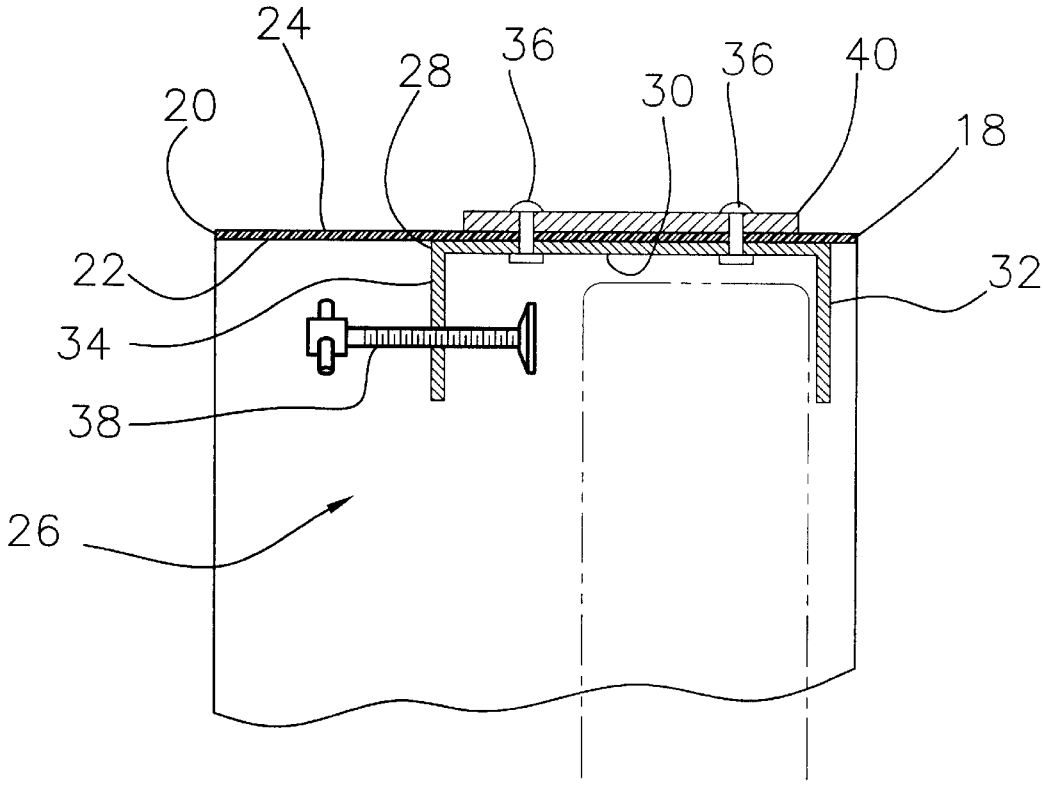
FIG. 3 is a schematic cross-sectional view taken along line 3—3 of FIG. 2 of the present invention.

With reference now to the drawings, and in particular to FIGS. 1 through 3 thereof, a new detachable circular saw guard embodying the principles and concepts of the present invention and generally designated by the reference numeral 10 will be described.

As best illustrated in FIGS. 1 through 3, the detachable circular saw guard 10 generally comprises the shield is removably attachable to a fixed blade guard 72 of a circular saw 70. The device 10 includes a panel 12 having a first end edge 14, a second end edge 16, a first side edge 18 and a second side edge 20. The panel 12 has an inner surface 22 and an outer surface 24. The panel 12 has an arcuate shape such that the first 18 and second 20 side edges generally have a half-circle shape. The panel 12 has a width from the first side edge 18 to the second side edge 20 preferably between 4 inches and 6 inches. The half-circle has a diameter preferably equal to 6 inches. The panel 12 comprises a rigid material which is ideally transparent.

A coupling means 26 is attached to the inner surface 22 of the panel for removably coupling the panel 12 to the blade guard 72 of the saw 70. The coupling means 26 includes a bracket 28 having a middle portion 30 and a pair of legs 32, 34 such that the bracket 28 generally has a U-shape. The middle portion 30 abuts the inner surface 22 such that a first of the legs 32 is positioned generally adjacent to the first side edge 18. A pair of fasteners 36 extend through the middle portion 30 and into the panel 12. A biasing means 38 biases the blade guard 72 against the first leg 32. The biasing means 38 extends through and is threadably engaged to a second of the legs 34. A support plate 40 is positioned against the outer surface 24 of the panel 12 such that the fasteners 36 extend through the support plate 40. The coupling means 26 is positioned generally intermediate of the first 14 and second 16 end edges.

In use, the device 10 is attached to the fixed blade guard 72 of the circular saw 70. The saw 70 has a movable blade guard 74 which is extendable into the fixed blade guard 72. The bracket 28 is positioned over the fixed blade guard 72 so that the blade guard 72 is between the legs 32, 34 and the biasing means 38 tightened against the fixed blade guard 72 to hold it against the first leg 32 of the bracket 28. The device 10 offers additional protection from pieces of wood or other materials which may be thrown upward by the blade.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable shield for a circular saw, the shield being removably attachable to a fixed blade guard of a circular saw, said shield comprising:

a panel having a first end edge, a second end edge, a first side edge and a second side edge, said panel having an inner surface and an outer surface, said panel having an arcuate shape such that said first and second side edges generally have a half-circle shape, said panel having a width from said first side edge to said second side edge generally between 4 inches and 6 inches, said half-circle having a diameter generally equal to 6 inches, said panel comprising a rigid material, said rigid material being generally transparent;

a coupling means being attached to said inner surface of said panel for removably coupling said panel to the blade guard, said coupling means including a bracket said bracket having a middle portion and a pair of legs such that said bracket generally has a U-shape, said middle portion abutting said inner surface such that a first of said legs is positioned generally adjacent to said first side edge, a pair of fasteners extending through said middle portion and into said panel, a biasing means for biasing the blade guard against said first leg, said biasing means extending through and being threadably engaged to a second of said legs, a support plate being positioned against said outer surface of said panel such that said fasteners extend through said support plate, said coupling means being positioned generally intermediate of said first and second end edges.

2. A removable shield for a circular saw, the shield being removably attachable to a fixed blade guard of a circular saw, said shield comprising:

a panel having a first end edge, a second end edge, a first side edge and a second side edge, said panel having an inner surface and an outer surface, said panel having an arcuate shape such that said first and second side edges generally have a half-circle shape;

a coupling means being attached to said inner surface of said panel for removably coupling said panel to the blade guard;

wherein said coupling means includes a bracket, said bracket having a middle portion and a pair of legs such that said bracket generally has a U-shape, said middle portion abutting said inner surface such that a first of said legs is positioned generally adjacent to said first side edge, a pair of fasteners extending through said middle portion and into said panel, a biasing means for biasing the blade guard against said first leg, said biasing means extending through and being threadably engaged to a second of said legs.

3. The removable shield as in claim 1, wherein said panel has a width from said first side edge to said second side edge generally between 4 inches and 6 inches.

4. The removable shield as in claim 1, wherein said panel comprises a rigid material, said rigid material being generally transparent.

5. The removable shield as in claim 1, further including a support plate being positioned against said outer surface of said panel such that said fasteners extend through said support plate.

6. The removable shield as in claim 1, wherein said coupling means is positioned generally intermediate of said first and second end edges.

* * * * *